US008899091B2

(12) United States Patent
Ramsey et al.

(10) Patent No.: US 8,899,091 B2
(45) Date of Patent: Dec. 2, 2014

(54) METHOD FOR PRODUCING SUCH A METAL CLOSURE WITH SEPARATE DISC AND RING FROM A SINGLE CLOSURE BLANK

(75) Inventors: Christopher Paul Ramsey, Wantage (GB); Paul Dunwoody, Wantage (GB)

(73) Assignee: Crown Packaging Technology, Inc., Alsip, IL (US)

( * ) Notice: Subject to any disclaimer, the term of this patent is extended or adjusted under 35 U.S.C. 154(b) by 514 days.

(21) Appl. No.: 12/513,049

(22) PCT Filed: Oct. 31, 2007

(86) PCT No.: PCT/EP2007/061744
§ 371 (c)(1),
(2), (4) Date: Apr. 30, 2009

(87) PCT Pub. No.: WO2008/053014
PCT Pub. Date: May 8, 2008

(65) Prior Publication Data

US 2010/0003109 A1 Jan. 7, 2010

(30) Foreign Application Priority Data

Oct. 31, 2006 (EP) ..... 06123299

(51) Int. Cl.
*B21D 51/44* (2006.01)
*B65D 51/14* (2006.01)

(52) U.S. Cl.
CPC ..... *B65D 51/145* (2013.01); *B65D 2101/0007* (2013.01); *B21D 51/44* (2013.01)
USPC ..... 72/379.4; 72/348; 72/336; 413/8

(58) Field of Classification Search
USPC ..... 72/329, 330, 336, 337, 347, 348, 379.4; 413/2, 4, 8
See application file for complete search history.

(56) References Cited

U.S. PATENT DOCUMENTS

| | | | | |
|---|---|---|---|---|
| 470,529 | A | 3/1892 | Williams | |
| 1,349,837 | A | 8/1920 | Johnson | |
| 1,699,069 | A | 1/1929 | Huntar | |
| 1,856,941 | A * | 5/1932 | Anderson | 220/787 |
| 2,139,682 | A | 12/1938 | Hothersall | |
| 2,166,923 | A | 7/1939 | Woodcock | |
| 2,216,082 | A | 9/1940 | Kronquest et al. | |

(Continued)

FOREIGN PATENT DOCUMENTS

| | | |
|---|---|---|
| DE | 2933547 | 3/1981 |
| DE | 3619322 | 12/1986 |

(Continued)

OTHER PUBLICATIONS

U.S. Appl. No. 12/922,989, filed Feb. 12, 2009, Dunwoody et al.

(Continued)

*Primary Examiner* — Shelley Self
*Assistant Examiner* — Pradeep C Battula
(74) *Attorney, Agent, or Firm* — Baker & Hostetler LLP

(57) ABSTRACT

A method of production for a 2-piece "Combo" style closure (1'), having a disk (10') constrained within a peripheral ring (20'). The "combo" style closure (1') is produced from a conventional one-piece closure shell (1) by cutting the side-wall (20) in the vicinity of the top plate (10) to produce the ring (20') and disc (10') respectively.

15 Claims, 14 Drawing Sheets

(56) References Cited

U.S. PATENT DOCUMENTS

| | | | | |
|---|---|---|---|---|
| 2,522,301 | A | 9/1950 | Rooney | |
| 2,527,885 | A | 10/1950 | Krueger | |
| 2,621,622 | A | 12/1952 | Henchert | |
| 2,702,597 | A | 2/1955 | Wickwire et al. | |
| 2,975,740 | A | 3/1961 | Smith et al. | |
| 2,991,602 | A | 7/1961 | Van De Kerke et al. | |
| D192,757 | S | 5/1962 | Foss et al. | |
| 3,068,344 | A | 12/1962 | Keinanen et al. | |
| 3,124,872 | A | 3/1964 | Knodel | |
| 3,157,080 | A | 11/1964 | Hanni | |
| 3,186,003 | A | 5/1965 | Gregory, Jr. et al. | |
| 3,380,419 | A * | 4/1968 | Moloney | 215/247 |
| 3,446,381 | A * | 5/1969 | Podesta | 215/333 |
| 3,581,691 | A | 6/1971 | Ringler | |
| 3,802,362 | A | 4/1974 | Daniel et al. | |
| 3,802,363 | A | 4/1974 | Langewis | |
| 3,813,972 | A | 6/1974 | Van Alsburg | |
| 3,836,033 | A * | 9/1974 | Podesta | 215/365 |
| 3,875,833 | A | 4/1975 | Kannegiesser et al. | |
| RE28,872 | E | 6/1976 | Larkin et al. | |
| D240,595 | S | 7/1976 | Kress | |
| 4,003,324 | A | 1/1977 | Tate et al. | |
| 4,004,478 | A | 1/1977 | Morgan | |
| D244,065 | S | 4/1977 | Daenen | |
| 4,022,141 | A | 5/1977 | Bartenstein | |
| 4,030,432 | A | 6/1977 | Miller et al. | |
| 4,087,018 | A * | 5/1978 | Tebbutt | 220/257.2 |
| 4,090,004 | A * | 5/1978 | Tebbutt et al. | 428/66.3 |
| 4,111,330 | A | 9/1978 | Jordan | |
| 4,171,063 | A * | 10/1979 | Cloutier | 220/789 |
| RE30,746 | E | 9/1981 | Stroobants et al. | |
| 4,299,147 | A | 11/1981 | Rogers | |
| D266,906 | S | 11/1982 | Guerette | |
| 4,473,163 | A | 9/1984 | Geiger | |
| 4,487,539 | A | 12/1984 | Taylor et al. | |
| 4,557,167 | A | 12/1985 | Cvacho | |
| 4,671,148 | A | 6/1987 | Thatcher | |
| 4,762,579 | A | 8/1988 | Shimizu et al. | |
| 4,808,053 | A * | 2/1989 | Nagai et al. | 413/30 |
| 4,914,990 | A | 4/1990 | Hellweg et al. | |
| 4,942,777 | A | 7/1990 | Fife | |
| 5,014,491 | A | 5/1991 | Tsukada et al. | |
| 5,078,564 | A | 1/1992 | Zago | |
| 5,146,818 | A | 9/1992 | Hellweg | |
| 5,287,713 | A | 2/1994 | Mine et al. | |
| 5,325,696 | A | 7/1994 | Jentzsch et al. | |
| 5,564,321 | A | 10/1996 | Rath | |
| 5,694,822 | A | 12/1997 | Maidment | |
| 5,782,599 | A | 7/1998 | Moran et al. | |
| 5,785,198 | A | 7/1998 | Credle, Jr. | |
| 5,839,869 | A | 11/1998 | Moran et al. | |
| D480,304 | S | 10/2003 | Stodd | |
| 6,662,958 | B2 | 12/2003 | German et al. | |
| D489,005 | S | 4/2004 | Miceli et al. | |
| 6,748,835 | B2 | 6/2004 | Dickey | |
| D522,364 | S | 6/2006 | Hicks et al. | |
| D526,740 | S | 8/2006 | Xu | |
| D536,975 | S | 2/2007 | Smith et al. | |
| 7,250,352 | B2 | 7/2007 | Mizutani et al. | |
| 7,387,474 | B2 | 6/2008 | Edler et al. | |
| 7,461,576 | B2 | 12/2008 | Dickey | |
| 7,506,529 | B2 * | 3/2009 | Bauer et al. | 72/379.4 |
| 7,526,938 | B2 * | 5/2009 | Dunwoody et al. | 72/379.4 |
| D612,196 | S | 3/2010 | Furlong | |
| 7,731,048 | B2 | 6/2010 | Alvares et al. | |
| 7,832,249 | B2 * | 11/2010 | Schumann et al. | 72/379.4 |
| D628,894 | S | 12/2010 | Pontes | |
| D645,741 | S | 9/2011 | Dunwoody | |
| D647,799 | S | 11/2011 | Dunwoody | |
| D650,275 | S | 12/2011 | Dunwoody | |
| D650,669 | S | 12/2011 | Dunwoody | |
| D650,670 | S | 12/2011 | Dunwoody | |
| D651,081 | S | 12/2011 | Dunwoody | |
| D651,082 | S | 12/2011 | Dunwoody | |
| D652,297 | S | 1/2012 | Dunwoody | |
| 8,091,455 | B2 | 1/2012 | McKeeth et al. | |
| 8,393,192 | B2 | 3/2013 | McEldowney et al. | |
| 2004/0016758 | A1 | 1/2004 | Richardson | |
| 2007/0090111 | A1 | 4/2007 | Alvares et al. | |
| 2011/0011866 | A1 | 1/2011 | Dunwoody | |
| 2011/0036134 | A1 | 2/2011 | Dunwoody | |

FOREIGN PATENT DOCUMENTS

| | | |
|---|---|---|
| EP | 0092884 | 11/1983 |
| EP | 0599549 | 6/1994 |
| EP | 1686070 | 8/2006 |
| EP | 1918041 | 5/2008 |
| FR | 620920 | 5/1927 |
| FR | 769264 | 8/1934 |
| FR | 2177118 | 11/1973 |
| WO | WO 95/11104 | 4/1995 |
| WO | WO 2005/063587 | 7/2005 |
| WO | WO 2008/053014 | 5/2008 |
| WO | WO 2009/060291 | 5/2009 |
| WO | WO 2009/115377 | 9/2009 |
| WO | WO 2009/130122 | 10/2009 |

OTHER PUBLICATIONS

U.S. Appl. No. 12/988,933, filed Apr. 6, 2009, Dunwoody et al.
U.S. Appl. No. 29/361,421, filed May 11, 2010, Dunwoody et al.
U.S. Appl. No. 29/361,422, filed May 11, 2010, Dunwoody et al.
U.S. Appl. No. 29/361,424, filed May 11, 2010, Dunwoody et al.
U.S. Appl. No. 29/361,437, filed May 11, 2010, Dunwoody et al.
U.S. Appl. No. 29/361,441, filed May 11, 2010, Dunwoody et al.
U.S. Appl. No. 29/361,443, filed May 11, 2010, Dunwoody et al.
U.S. Appl. No. 29/361,446, filed May 11, 2010, Dunwoody et al.
U.S. Appl. No. 29/361,448, filed May 11, 2010, Dunwoody et al.
U.S. Appl. No. 29/361,449, filed May 11, 2010, Dunwoody et al.
U.S. Appl. No. 29/382,732, filed Jan. 6, 2011, Ramsey.
U.S. Appl. No. 29/382,735, filed Jan. 6, 2011, Dunwoody.
U.S. Appl. No. 29/382,738, filed Jan. 6, 2011, Dunwoody.
U.S. Appl. No. 29/382,739, filed Jan. 6, 2011, Dunwoody.
U.S. Appl. No. 29/382,744, filed Jan. 6, 2011, Dunwoody.
Dunwoody et al., U.S. Appl. No. 29/361,449, "Closure Cap", filed May 11, 2010, 11 pages.
Ramsey, U.S. Appl. No. 29/382,732, "Closure Cap", filed Jan. 6, 2011, 12 pages.
Ramsey, U.S. Appl. No. 29/382,735, "Closure Cap", filed Jan. 6, 2011, 4 pages.
Ramsey, U.S. Appl. No. 29/382,738, "Closure Cap", filed Jan. 6, 2011, 5 pages.
Ramsey, U.S. Appl. No. 29/382,739, "Closure Cap", filed Jan. 6, 2011, 4 pages.
Ramsey, U.S. Appl. No. 29/382,744, "Closure Cap", filed Jan. 6, 2011, 5 pages.

* cited by examiner

METHOD FOR PRODUCING SUCH A METAL CLOSURE WITH SEPARATE DISC AND RING FROM A SINGLE CLOSURE BLANK

TECHNICAL FIELD

The present invention concerns a metal closure having a sidewall and separate disc, which forms the top plate of the closure.

BACKGROUND ART

A closure comprising a plastic sidewall and a metal disc is well known and a closure of this type is commonly referred to as a "combo closure". Conventionally, the sidewall or "ring" is made from a plastic material by injection moulding. This plastic ring defines threads, which cooperate with similar threads on a container neck. A tamper evident band is defined at the free end of the "ring" and joined thereto by frangible bridges. The frangible bridges are designed to break upon opening of the closure, to indicate to a user of the closure/container package that the closure has been opened previously. Sealing compound is conventionally applied to the metal disc to form a seal between the metal disc and the mouth of the container.

Patent Citation 0001: U.S. Pat. No. 6,662,958 B (CROWN, CORK & SEAL TECHNOLOGIES CORPORATION). 2003 Dec. 16.

relates to such a closure. An advantage of this type of closure is that the tamper evident band breaks before the seal between the metal disc and the container is broken, giving a user confidence that the contents within the container has not been subject to tampering.

The 2-piece closure design allows the breaking of the container seal to be controlled. The initial twisting of the closure "ring" activates the tamper-evident feature, such as breaking a tamper-evident band, whilst the disc remains sealed to the container. Thereafter, a further feature may be provided on the closure "ring" to prise the disc from the container, thereby breaking the seal between the disc and the container to equalise any difference between the internal pressure in the container and the external environment. This 2-stage opening reduces the torque required to open the closure and allows the closure to be removed more easily.

Disadvantages of the arrangement described in

Patent Citation 0002: U.S. Pat. No. 6,662,958 B.

are that the combination of metal and plastic material makes the closure more difficult to recycle. Also, the recent increase in plastic raw material costs makes the closure relatively expensive to manufacture and the plastic "ring" prevents the use of the closure on packages, which are subjected to a retort process.

Combo closures having a metal ring confining a glass top plate (or disc) are well known in the prior art and are used for home preserving. However, these closures are also made from two materials (metal and glass), which must be recycled separately.

Patent Citation 0003: EP 1686070 A (PLATO PRODUCT CONSULTANTS). 2006 Aug. 2.

describes a "combo" closure comprising a disc and a ring shaped element. A "special feature" is described, which reduces the torque required to unscrew the closure from a container. The closure described in this document utilises a separate, annular gasket, which enhances the seal between the closure and the container to which the closure is affixed.

DISCLOSURE OF INVENTION

If an all-metal equivalent of the known "combo closure" were provided, this would allow a user to gain the benefit of reduced opening torques, whilst a package incorporating the closure may pass through a retort process as currently used for one-piece metal twist closures. Such an all-metal "combo" closure would be easier to recycle as it is substantially composed of only one material. Furthermore, if the closure were manufactured from a conventional metal, twist closure shell, existing capping equipment may be used to apply the closure to the container.

The cost of manufacturing such an all-metal closure requires efficient use of metal raw material to reduce wastage. A problem arising from manufacture of a metal version of a "combo" closure comprising a metal ring and a metal disc is that if both these meal components are produced from separate pieces of material, the amount of wastage is significant. Alternatively, if a "disc" is simply cut from the top plate of a conventional metal closure blank, this disc will not be constrained by the remaining "ring". This is because the "disc" will be able to pass through the resulting hole in the "ring" will be too large to constrain the aforementioned disc.

Accordingly, the present invention provides a method of manufacture for a metal closure having separate disc and a circumferential ring, including the steps of

- drawing a closure blank from a sheet of metal, the closure blank having a top plate and a sidewall depending from the periphery thereof,
- cutting the sidewall of the closure blank adjacent to the top plate to produce a disc and a circumferential ring both having a cut edge.

The closure according to the invention is made predominantly from metal (except for a small quantity of sealing compound), which improves a user's ability to recycle the closure after it is no longer needed. Lugs may be provided at the edge of the ring opposite the disc according to conventional processes.

Preferably, a curl is formed at the free edge of the closure blank prior to separation of the sidewall (ring) from the top plate (disc). A curl protects the cut edge of the closure blank, preventing injury etc. and provides rigidity to the ring upon separation of the sidewall from the top plate.

The sidewall of the closure blank is cut adjacent to the top plate, to provide a ring and a separate disc. The closure blank may be cut using any conventional process e.g. laser cutting. The disc thus produced, will have the same diameter as the ring. Therefore, the cut edge of the disc is hemmed or curled to reduce its outside diameter and thereby allow it to be inserted into the ring.

Alternatively, the sidewall of the closure blank may be separated from the top plate by the known process of "clip trimming". This process requires that the top of the sidewall (adjacent to the top plate) is first drawn to a smaller diameter by a first punch and die and then severed by a second punch part having a sharp corner and a diameter between that of the die and the first punch part. This technique is most commonly used for trimming metal container bodies or for trimming thin aluminium Roll On Pilfer Proof (ROPP) closures. The advantage of this technique is that the diameter of the disc is reduced and the subsequent hemming of the disc is not required.

In one embodiment of the invention, the disc is supported in the ring so that the cut edges of both the ring and the disc are proximate one another and then the cut edges of the ring and the disc are loosely curled together. This embodiment has the advantage that the ring requires no retention features because the loose curl loosely retains the disc within the ring, whilst allowing the disc both axial and rotational movement.

Finally, in another embodiment of the invention, an alternative blank configuration is proposed which allows the disc and the rink to be loosely curled together as discussed above, but in this embodiment the external surface of the blank may be printed or treated before separating into a disc and ring. The disc and ring may then be assembled as described above, but in this embodiment, both the external surface of the disc and the ring is already printed or treated.

Tamper evidence may be provided on the 2-piece metal closure by taking advantage of the fact that the ring and the disc are independent and move separately upon initial opening of the closure. Thus initially, when the ring is twisted by a defined amount, the disc remains sealed to the container and does not move. A frangible bridge or label may be secured to the disc and the ring and upon an attempt to remove the closure, the relative movement of the ring relative to the disc breaks the frangible bridge or label, giving a visual indication that an attempt has been made to remove the closure from the container.

BRIEF DESCRIPTION OF FIGURES IN THE DRAWINGS

The present invention will now be described, by way of example only, with reference to the accompanying drawings, in which.

Figure 6A:
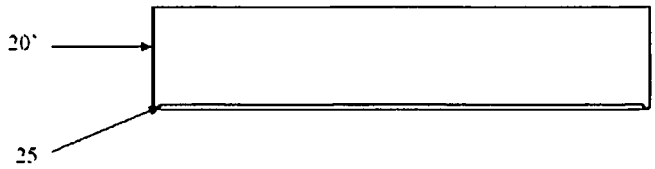
FIG. 6A shows a schematic side section view of the ring shown in FIG. 3C after the top and sidewall of the closure have been severed.
Figure 6B:
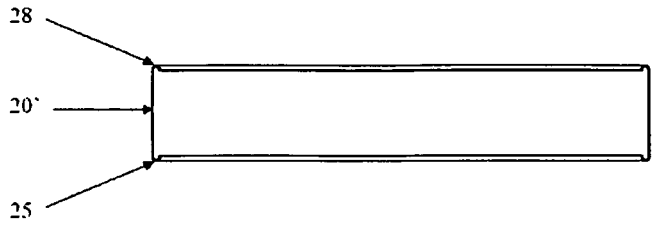
FIG. 6B shows a schematic side section view of the ring shown in FIG. 6A after formation of a ring curl at the cut edge of the ring.
Figure 6C:
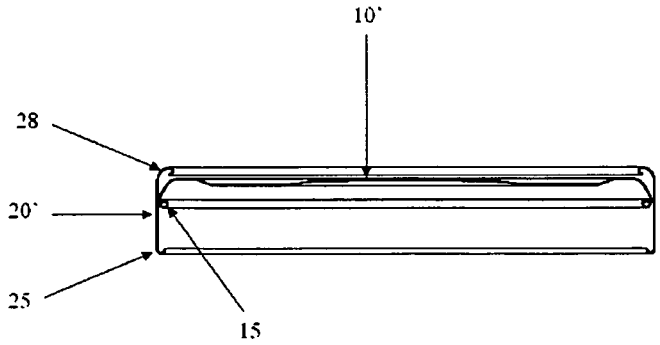
FIG. 6C shows a schematic side section view of a metal closure according to the invention after the disc has been inserted into the ring shown in FIGS. 6A and 6B.
Figure 6D:
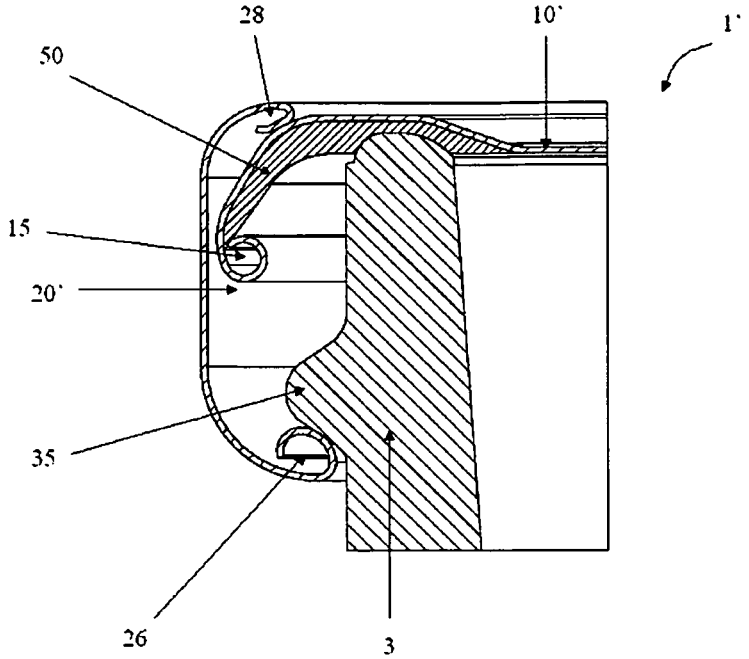
FIG. 6D shows a detailed cross section view of a portion of the finished 2-piece closure shown in FIG. 6C, with the closure tightened onto a container to form a seal between the disc and the container. In this arrangement, there are no retention features and the disc is free to move axially within the ring.
Figure 6E:
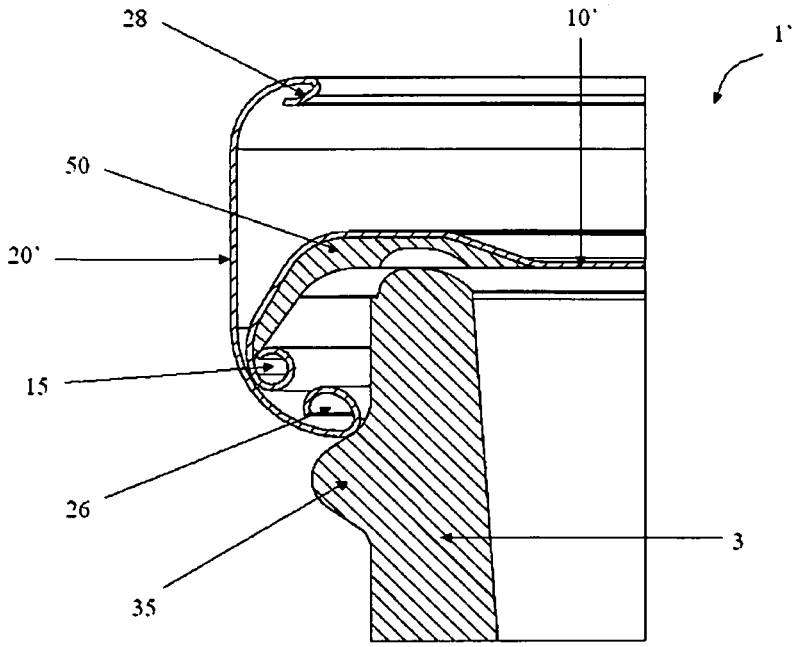

FIG. 6E shows the same portion of the 2-piece closure shown in FIG. 6D after the ring has been unscrewed, the lugs on the ring have lifted the disc from the container and the seal between the disc and the container has been broken. By using the method illustrated in FIGS. 6A to 6E, there is no need to invert the disc 10' or the ring 20'. Furthermore, the lugs 26 are formed in the closure curl 25, which has a greater work-hardening than the ring curl 28, formed at the cut-edge of the ring 20'.

Figure 7:
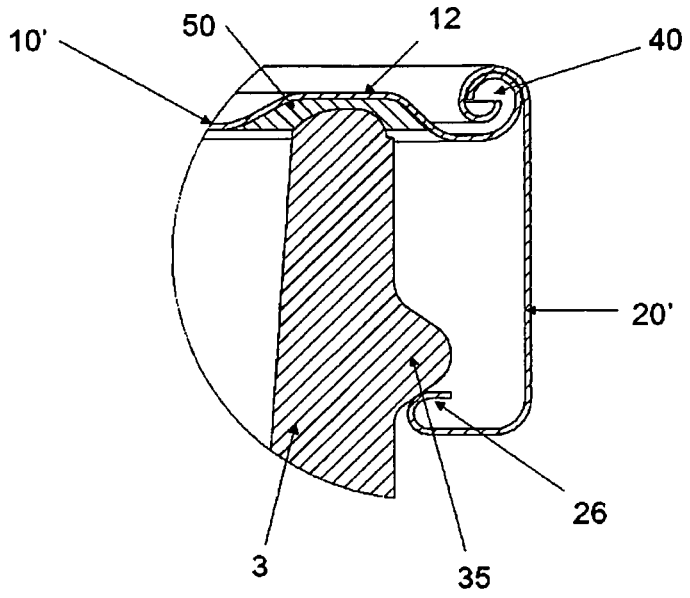

FIG. 7 shows a detailed cross section view of a portion of the 2-piece closure according to a second embodiment of the invention having a disc and a ring, where the cut edges of the disc and the ring are loosely curled together, allowing the disc space to move both axially and rotationally within the ring;

FIG. 8A to FIG. 8D show a similar schematic progression to that shown in FIG. 3A to FIG. 3D and FIG. 4A to FIG. 4C for the second embodiment of the invention shown in FIG. 7; and FIG. 9A to FIG. 9D show a similar schematic progression to that shown in FIG. 8A to FIG. 8D for a modification to the second embodiment of the invention shown in FIG. 7 allowing the external surface of the closure blank to become the external surface of the 2-piece closure.

All same or similar components in the figures have been labelled using the same or similar reference numerals respectively.

Figure 1:
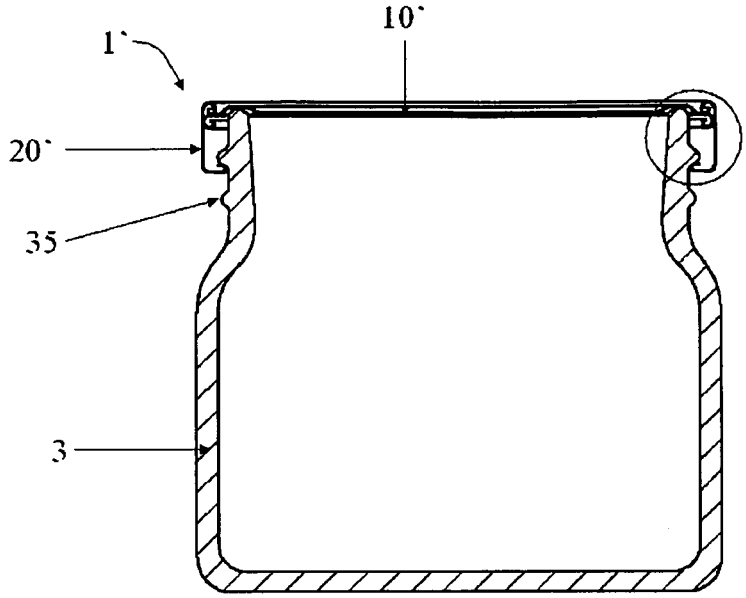
FIG. 1 shows a cross sectional view of a 2-piece closure attached to a container, indicating (by a circle) the area illustrated in all detailed cross section views included in the accompanying Figures.

Referring to FIG. 1, which is primarily included to illustrate the location of the various detailed views in the remaining figures, a package comprises a threaded container 3 and a 2-piece closure 1' having a disc 10' and a peripheral ring 20'.

Figure 2:
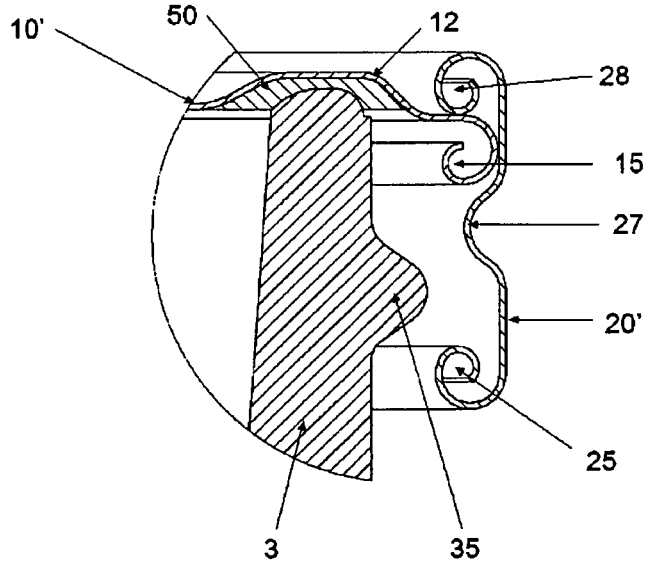
FIG. 2 shows a detailed cross section view of a portion of the 2-piece closure according to a first embodiment of the invention having a disc and a ring, the cut edge of the ring is curled to constrain the disc therein and retention features are formed in the ring to locate the disc in its desired position.

FIG. 2 shows a detailed view of part of the package illustrated in FIG. 1. The 2-piece closure comprises a metal disc 10'; whose cut edge is protected by a curl 15 and a circumferential ring 20'. The disc 10' is trapped within the ring by two curls 25, 28 at the opposed axial ends of the ring 20'. A retention feature, or features 27 are provided to position the disc 10' loosely within the ring 20', whilst allowing the disc 10' freedom to move both axially and rotationally relative to the ring 20'. The retention feature 27 may take the form of a plurality of lugs spaced around the circumference of the ring 20' or alternatively may be provided by a circumferential bead, either full or segmented. A channel 12 is provided about the inside periphery of the disc 10' and this channel is used to hold sealing compound 50. The provision of the channel 12 ensures the proper location of the sealing compound to interface with the neck of the container 3 and also reduces the quantity of sealing compound 50, because of its better and more accurate distribution.

Figure 3A:
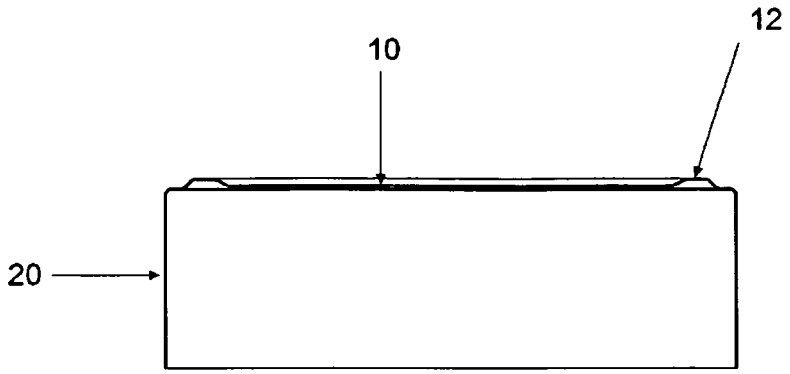
FIG. 3A shows a schematic side section view through a closure blank, conventionally used to make a one-piece closure, but which is suitable for use in the invention.
Figure 3B:
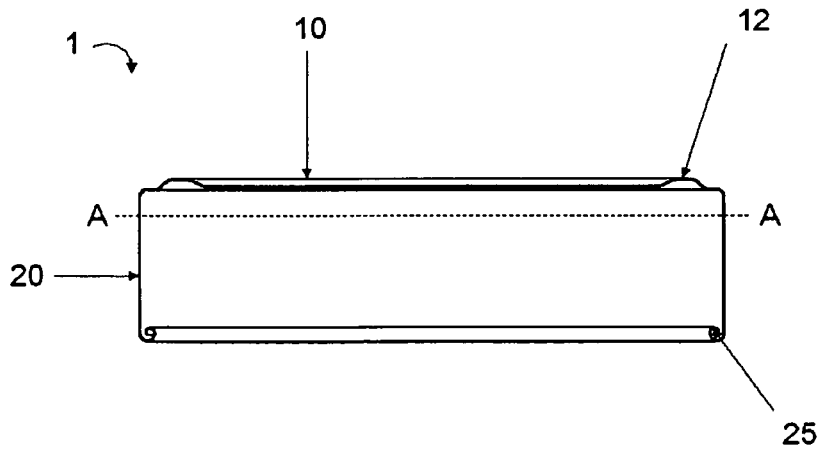
FIG. 3B shows the schematic side section view of the closure blank of FIG. 3A after a curl has been formed at the free edge of the closure skirt, indicating where the top may be cut from the sidewall of the closure to form a disc and a ring.
Figure 3C:
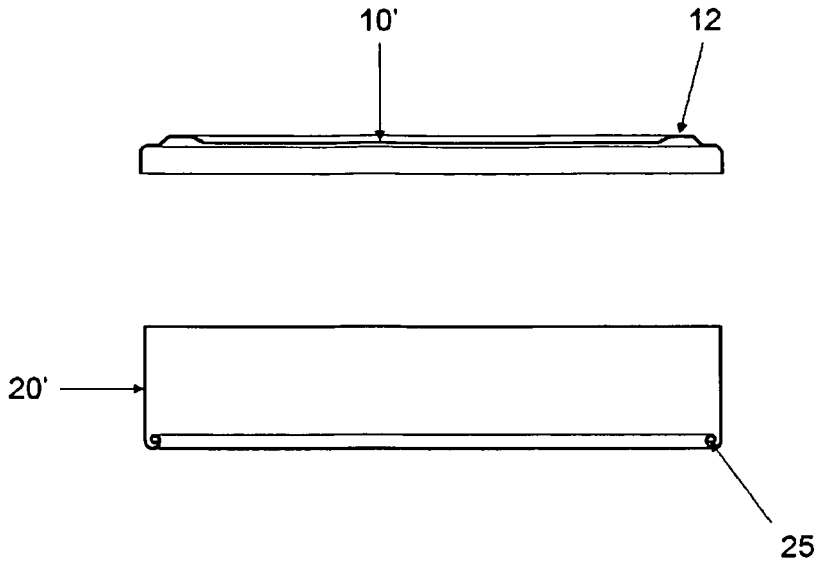
FIG. 3C shows a schematic side section view of the closure blank shown in FIG. 3B after the top and side wall of the closure have been severed to form a disc and a ring.
Figure 3D:
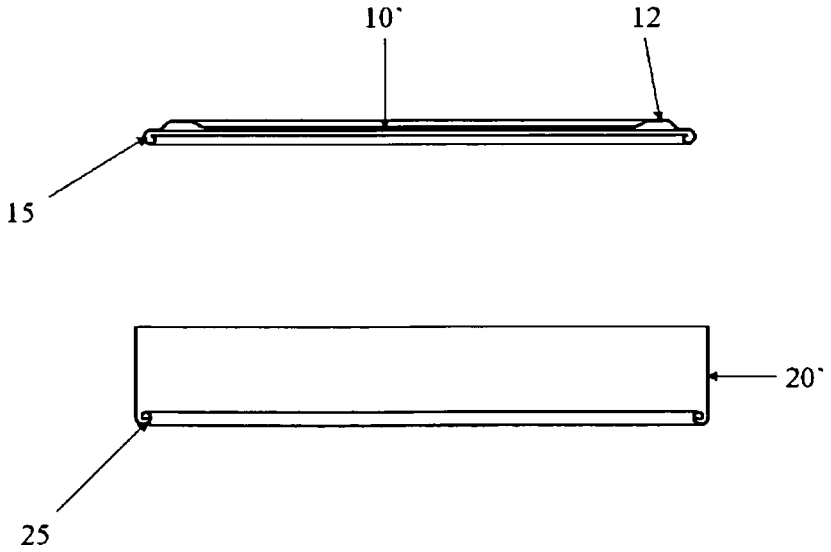
FIG. 3D shows a schematic side section view of the modified closure blank shown in FIG. 3C after formation of a curl around the cut edge of the disc.

FIGS. 3A to 3C show a schematic progression for manufacture of the 2-piece metal closure shown in FIG. 2. First a conventional closure blank 1 for a one-piece metal closure is drawn from a sheet of metal (see FIG. 3A). The closure blank has a top plate 10 and sidewall 20, which depends from the periphery of the top plate 10. A recess 12 for sealing compound may be defined adjacent the periphery of the top plate 10, but this is not essential.

The free-edge of the sidewall 20 is formed into a closure curl 25, making a one-piece metal closure shell 1. The closure shell 1 may be cut at line A-A (see FIG. 3B) by conventional techniques, such as rotary cutting, laser cutting or clipping. Cutting the closure blank 1 along line A-A separates the closure blank into two separate components, a disc 10' and a ring 20' (as shown in FIG. 3C). The cut edge of the disc 10' is rolled into a curl 15 and the curl 15 both provides cut edge protection and reduces the outside diameter of the disc 10' so that it can fit into the ring 20', through the raw cut-edge of the ring 20' (see FIG. 3D). The raw cut edge of the ring 20' may then also be curled to provide both cut edge protection and to constrain the disc 10' within the ring 20' (as illustrated in FIG. 2). Once the disc 10' is constrained within the ring 20', the position of the disc may be more closely controlled by the provision of retention feature or features 27.

Figure 4A:
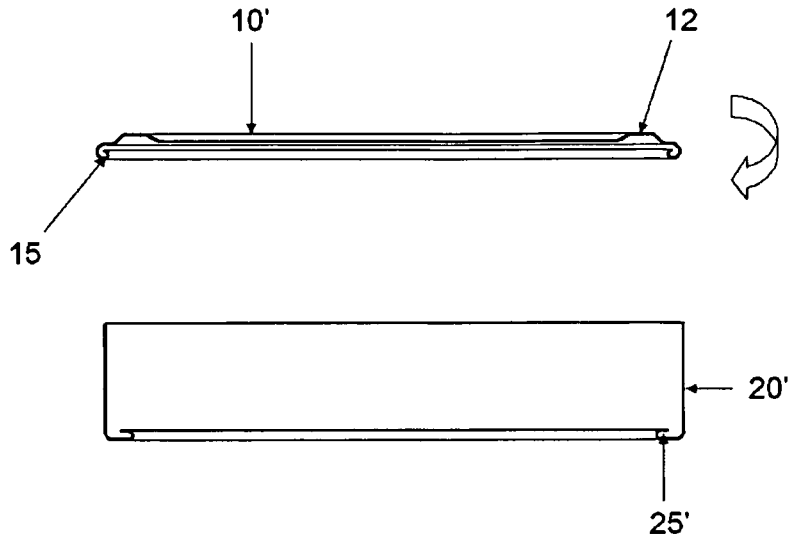
FIG. 4A shows a schematic side section view of the modified closure blank shown in FIG. 3C according to another embodiment of the invention in which the closure curl (on the ring) is flattened and the disc is inverted before insertion into the ring.
Figure 4B:
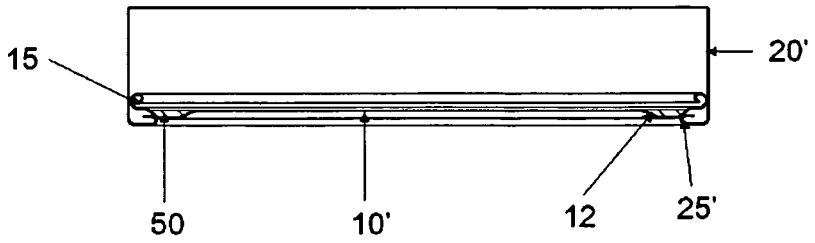
FIG. 4B shows a schematic side section view of the modified closure blank shown in FIG. 4A with the disc inverted, inserted into the ring and supported against the fattened curl.
Figure 4C:
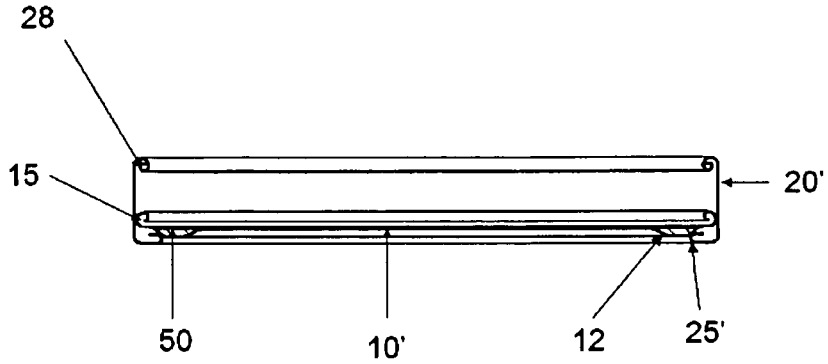
FIG. 4C shows a schematic side section view of the modified closure blank shown in FIG. 4B after formation of a curl at the cut edge of the ring.

Referring to FIG. 4A, the manufacturing process may be modified by flattening the closure curl 25' prior and inverting the disc 10' or the ring 20' and assembling the disc 10' in the ring 20'. As shown in FIG. 4B, in this arrangement, the disc 10' is supported by the fattened curl 25'. At this stage, sealing compound 50 is inserted into the channel 12. Lugs or similar conventional means for securing the closure to the container (not shown) may be provided in the curl 28 or in the ring 20'.

Figure 4D:
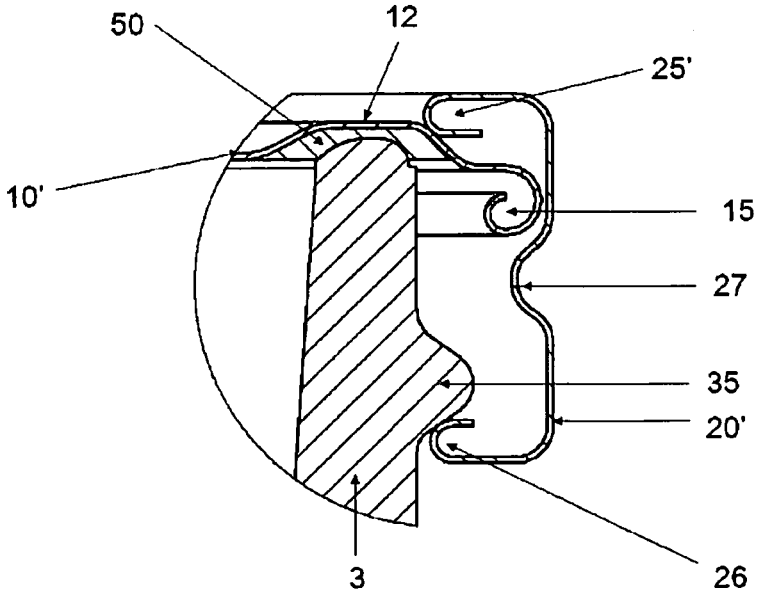
FIG. 4D shows a detailed cross section view of a portion of the finished 2-piece closure according to the alternative embodiment of the invention. In this arrangement, retention features are formed in the ring to locate the disc in its desired position and with the closure tightened onto a container to form a seal between the disc and the container.

The flattened curl of the modified closure shown in FIG. 4A to 4E has the advantage that conventional belt capping systems, having one or more belts, which contact the top surface of the closure, may be used to apply the modified 2-piece closure to the container 3. Referring to FIG. 4D, when the closure is tightly applied to the container 3, the fattened curl 25' urges the disc 10' towards the mouth of the container and the interaction between the container threads 35 and the closure lugs 26 or the like, tighten the seal formed by the sealing compound 50 and the container 3.

Figure 4E:
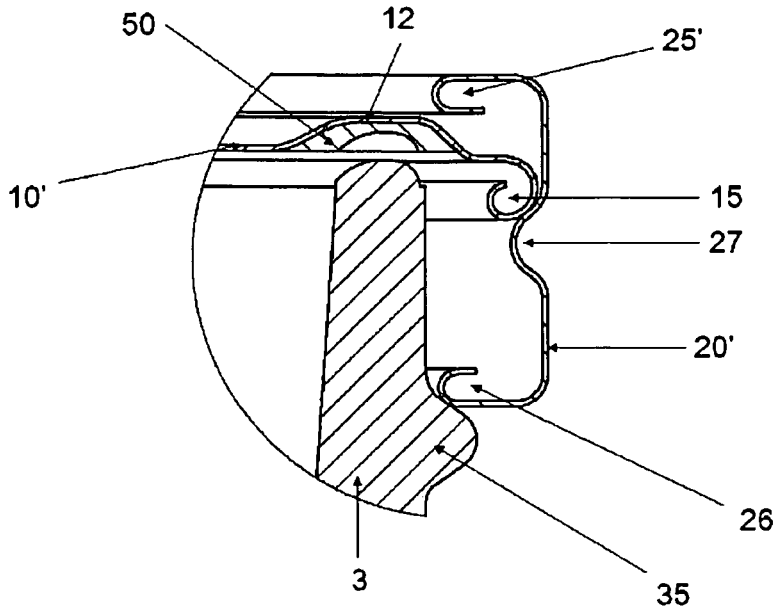
FIG. 4E shows the same portion of the 2-piece closure shown in FIG. 4D after the ring has been unscrewed, the retention feature has lifted the disc from the container and the seal between the disc and the container has been broken.

Referring to FIG. 4E, upon opening the closure, the lugs 26 ride past the container thread 35 the retention feature 27 engages with the disk curl 15, lifts the disk 10' and breaks the seal between the sealing compound 50 and the container 3. Upon initial turning of the closure on the container 3, the disc 10' remains sealed to the mouth of the container 3 whilst the ring turns and lifts slightly. This relative movement between the disc 10' and the ring 20' may be use to trigger some form of tamper evidence. For example, a frangible bridge (such as a paper label) may be anchored to both the ring 20' and the disc 10' and the relative movement of the ring 20' relative to the disk 10' may sever the frangible bridge giving a visible indication that an attempt has been made to open the package.

Figure 5:
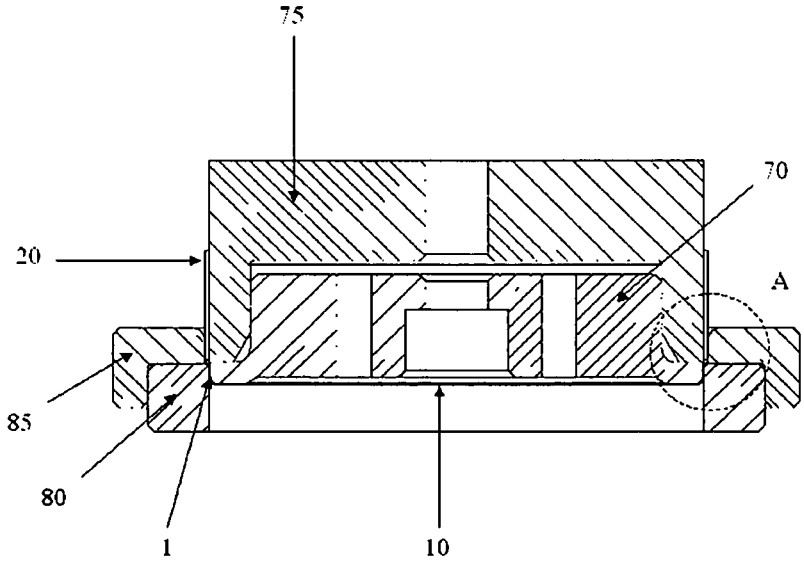
FIG. 5 is a schematic view of the punch and die arrangement used for "Clip trimming" the closure to separate the sidewall and top pate, whilst reducing the outside diameter of the top plate/"disc". The portion of the tooling utilised in the enhanced view (see FIG. 5A) is indicated by the circle labelled "A".
Figure 5A:
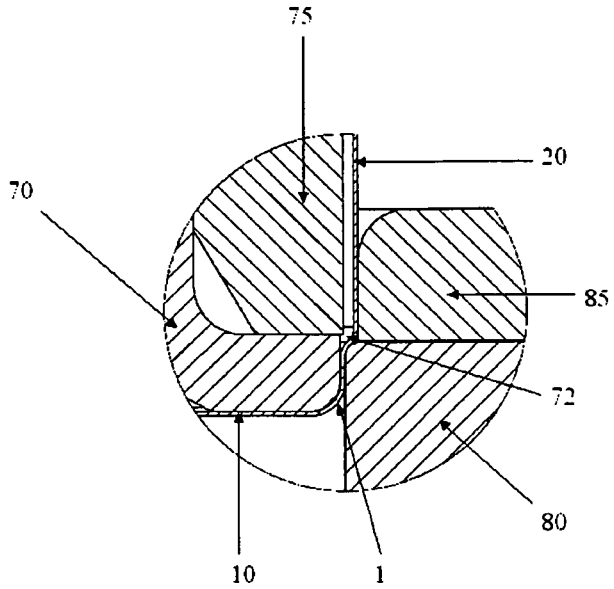
FIG. 5A is an enhanced view of a portion of the tooling shown in FIG. 5.

FIGS. 5 and 5A illustrate how the punch and die arrangement used for "clip trimming" may be used to sever the top plate 10 from the sidewall 20 of a closure blank 1 to form a ring and a disc of reduced diameter. Part of the sidewall 20 of a closure blank 1 is first drawn to a smaller diameter by a first punch part 70 and a die 80. The closure 1 is held by the location ring 85, whilst the reduced diameter part of the closure blank 1 is then severed from the remainder of the sidewall 20 by a second punch part 75 defining a sharp corner 72 and having an outside diameter between that of the die 80 and the first punch part 70. Using such a method, the diameter of the disc is reduced and subsequent hemming of the periphery of the disc is not needed to reduce the diameter of the disc to fit inside the ring.

In another embodiment, after cutting from the disc, the cut edge of the ring 20' is provided with a ring curl 28, to protect the cut edge of the ring 20' (as shown in FIGS. 6A and 6B). The ring 20' is then flexed to allow the previously formed disc 10' to be inserted into the ring 20' from below (as shown in FIG. 6C). Finally, the disc 10' is retained within the ring 20' by forming lugs 26 (as shown in FIG. 6D). The steps of inserting the disc 10' into the ring 20', forming the ring curl 28 and forming the lugs 26 may be carried out in any sequence to produce the closure shown in FIG. 6D. Also, optionally, the disc 10' may be inserted into the ring 20' from above, which may be advantageous as there is no need to flex the ring 20'

The closure shown in FIGS. 6D and 6E is similar to that illustrated and described with respect to FIGS. 4D and 4E, but without any retention feature. Referring to FIG. 6D, when the closure is tightly applied to the container 3, the ring curl 28 urges the disc 10' towards the mouth of the container and the interaction between the container threads 35, the lugs 26 and the ring curl 28, tighten the seal formed by the sealing compound 50 against the container 3. Upon opening (see FIG. 6E) the closure 1', the lugs 26 ride past the container thread 35, whilst the disc 10' remains sealed to the mouth of the container 3. The ring 20' continues to turn and lift until the lugs 26 engage with the disc curl 15. The lugs 26 lift the disc 10' and break the seal between the sealing compound 50 and the container 3. Thus, the closure "lifts" and then "pops", as the seal between the disc 10' and container 3 is broken.

FIG. 7 illustrates another embodiment of the invention, in which the cut edge of the ring 20' and disc 10' are loosely curled together. This embodiment also removes the need for a separate retention feature to control the position of the disc 10' within the ring 20'.

Figure 8A:
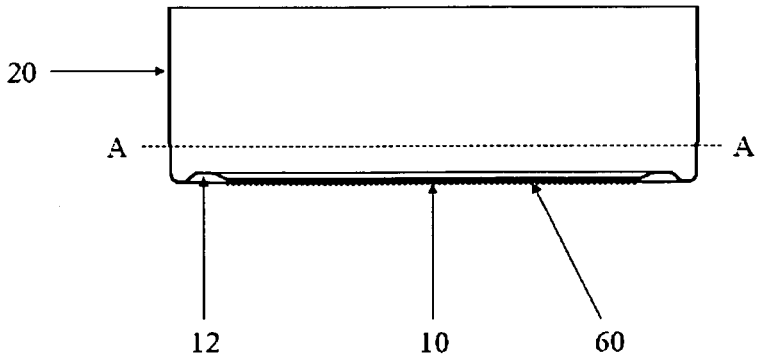
Figure 8B:
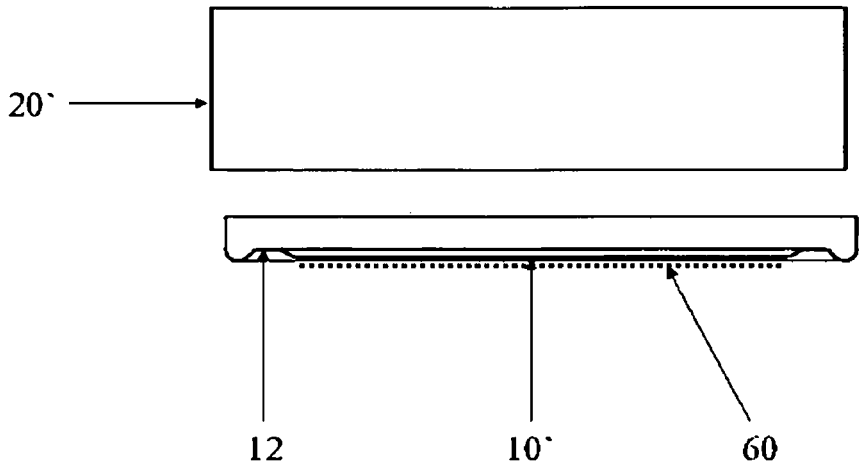
Figure 8C:
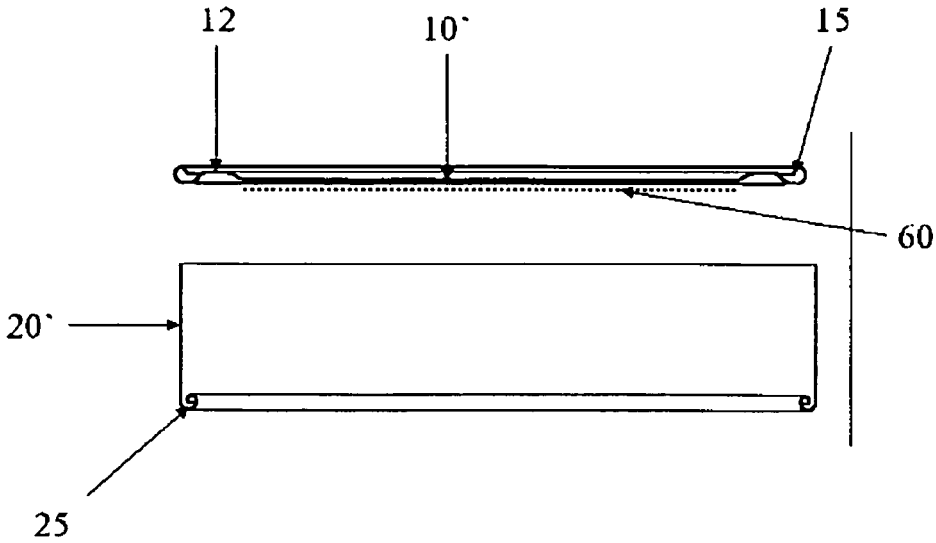

FIG. 8A to 6D show a progression for manufacture of the 2-piece metal closure shown in FIG. 7. A metal blank, comprising a top 10 and a sidewall 20 is drawn from a sheet of metal and the closure blank is again severed along line A-A producing a blank for a disc 10' and a ring 20'. The closure blank shown in FIG. 8A may be decorated with a coating, lacquer or some other decoration 60 prior to severing along line A-A. Decorating the closure blank rather than the separate disc 10' and ring 20' of FIG. 8B is advantageous, because the closure blank is easier to handle, than the separate ring 20' and disc 10'. The problem associated with providing decoration on the external surface of the closure blank shown in FIG. 8A is that when the disc 10' and ring 20' are formed and assembled (see FIG. 8B to 8D) the decoration 60 is located on the internal surface of the disc 10' and will not be seen by a user of the closure before first use. However, this disadvantage nay be turned to an advantage, if the disc 10' is used to provide prize information etc., which is only required upon opening the closure.

Figure 9A:
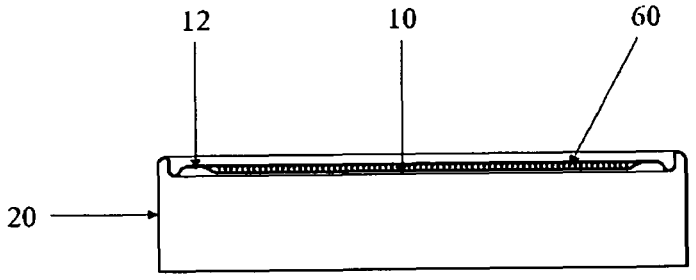
Figure 9B:
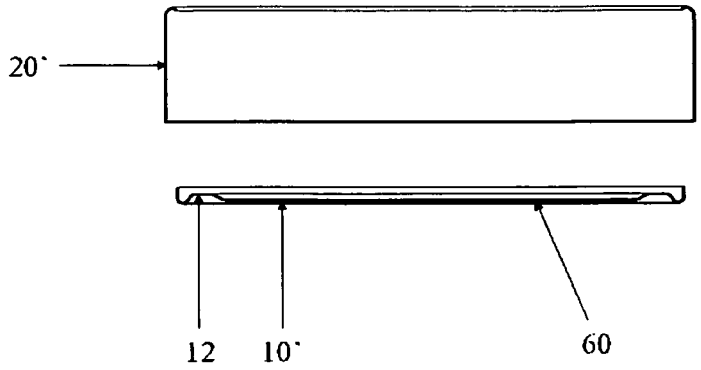

A modification to the closure blank provided in FIG. 8A is illustrated in FIG. 9A. In this arrangement, the external surface of the closure blank may be decorated before forming the disc 10' and ring 20' (see FIG. 9B) and the decoration 60 will then be located on the external surface of the disc 10' (see FIG. 9B to 9D). The manufacturing method used to produce the embodiment shown in FIG. 7 is thereafter the same.

Referring to FIG. 8A and FIG. 9A a closure blank is drawn in a single piece from a sheet of metal. The closure blank is then severed between the top 10 and sidewall 20 to form a disc 10' and ring 20' (see FIG. 8B and FIG. 9B). Referring to FIG.

Figure 9C:
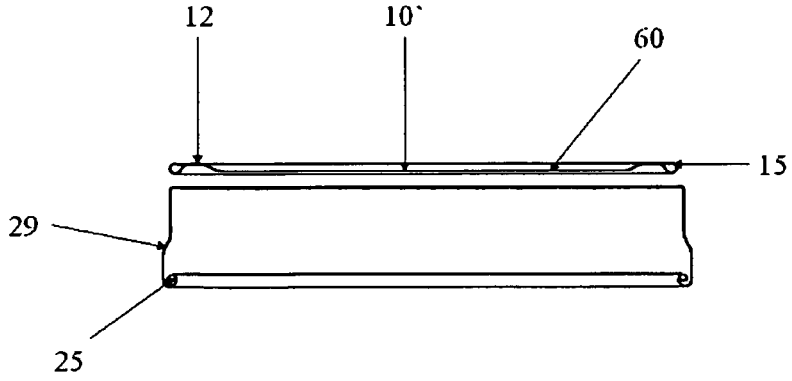

8C and FIG. 9C the cut edge of the disk 10' is hemmed (the start of a loose curl 15 is formed) to reduce the external diameter of the disc 10' so that it fits into the cut edge of the ring 20'. Also, one axial end of the ring 20' is formed into a curl 25.

Figure 8D:
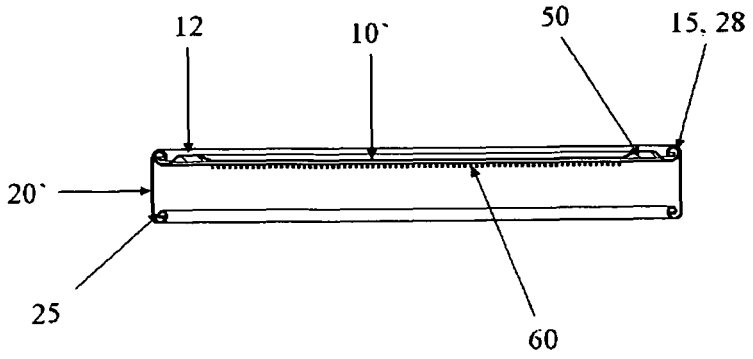
Figure 9D:
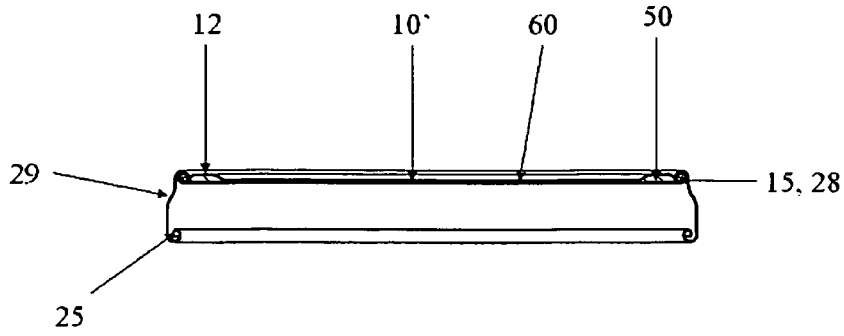
Figure 9E:
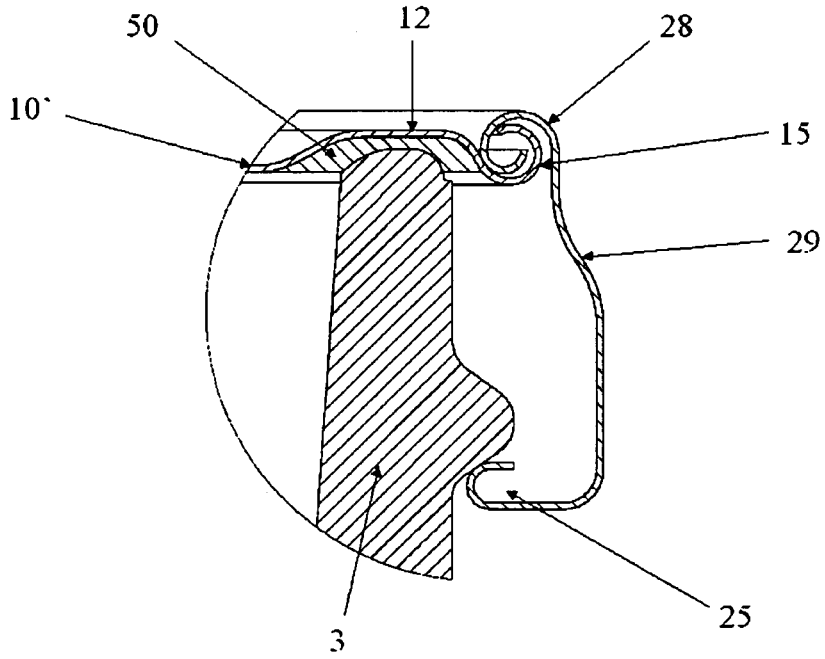

As illustrated in FIG. 8D and FIG. 9D the hemmed disc 10' is inserted into the ring 20' and supported therein so that the cut edge of the disc 10' and ring 20' are proximate. The cut edge of the ring 20' is then curled loosely around the hemmed edge of the disc 10' to form a 2-piece closure as illustrated in the detailed cross section views of FIG. 7 and FIG. 9E. In this arrangement, the disc 10' is constrained loosely within the ring 20' by the loose curl 15, 28. The loose curl 15, 28 is designed to allow the disk 10' rotational movement as well as a limited degree of axial movement.

The embodiment illustrated in FIG. 9A to 9E shows one further modification, which may be applied to any of the embodiments of the invention described previously. It can be seen that the ring 20' illustrated in FIG. 9A to 9E has a transition 29 by which the diameter of the ring 20' ray be reduced, making the finished closure more compact.

Preferably, in any of the embodiments of the invention described above, sealant 50 is applied in the groove 12 of the disc 10', prior to assembly of the disc 10' in the ring 20'. This eases manufacture, because the disc 10' is easier to control and handle when separate than when assembled in the ring 20'.

The invention claimed is:

1. A method of manufacture for a twist metal closure having separate disc and circumferential ring, the method comprising the steps of:

drawing a closure blank from a metal sheet into a cup, the cup having a top plate and a sidewall that is downwardly depending from the periphery of the top plate and has a free edge, cutting the cup adjacent to the top plate to produce the disc and the circumferential ring, each one of the disc and the ring having a cut edge; and assembling the disc and the ring together, the assembling step including curling the free edge and the cut edge of the ring into upper and lower curls and inserting the disc into the ring, such that the ring traps the disc between the upper and lower curls formed in the ring to thereby form the twist metal closure.

2. A method of manufacture of a twist metal closure according to claim 1, further comprising hemming the periphery of the disc around its cut edge to reduce the outside diameter of the disc, thereby enabling insertion of the disc into the ring.

3. A method of manufacture of a twist metal closure according to claim 2, wherein the assembling step comprises the steps of:

inserting the hemmed disc into the ring and after the inserting step, curling the cut edge of the ring around the hemmed periphery of the disc to form a loose curl.

4. A method of manufacture of a twist metal closure according to claim 1 wherein the step of curling the free edge occurs prior to the step of cutting the top plate from the sidewall to form the disc and ring, the curled free edge defining one of the upper curl or the lower curl of the ring.

5. A method of manufacture of a twist metal closure according to claim 4, wherein the step of curling the free edge comprises forming the curled free edge such that the curled free edge is flattened.

6. A method of manufacture of a twist metal closure according claim 1, wherein the assembling step further comprises inserting the disc into the ring through the cut edge of the ring such that the disc is supported by one of the upper curl or the lower curl prior to curling the cut edge of the ring.

7. A method of manufacture of a twist metal closure according to claim 1, wherein the assembling step comprises inserting the disc into the ring between the upper and lower curls, wherein the ring is deformed to allow the disc to be inserted into the ring.

8. A method of manufacture of a twist metal closure according to claim 1, wherein the step of drawing the closure blank comprises forming a channel adjacent a periphery of the top plate, the method further comprising applying a sealing compound to the channel, the sealing compound being arranged to form a seal with a container.

9. A method of manufacture of a twist metal closure according to claim 1 further comprising decorating the closure blank prior to the cutting step.

10. A method of manufacture of a twist metal closure according to claim 1, further comprising forming a retention feature in the ring, the retention feature configured to position the disc within the ring such that the disc can move axially and rotationally relative to the ring.

11. A method of manufacture of a twist metal closure according to claim 10, wherein the step of forming a retention feature comprises forming a plurality of lugs spaced around a circumference of the ring.

12. A method of manufacture of a twist metal closure according to claim 1, wherein the assembling step further comprises forming the cut edge of the ring into a curl that defines the lower curl after the disc has been disposed within the ring.

13. A method of manufacture of a twist metal closure according to claim 12, wherein the lower curl is formed so as to be provided with lugs that are configured to engage threads of a container.

14. A method of manufacture of a twist metal closure according to claim 1 wherein the assembling step comprises:

curling the free edge of the ring;

after curling the free edge of the ring, inserting the disc into the ring; and after inserting the disc into the ring, curling the cut edge of the ring.

15. A method of manufacture of a twist metal closure according to claim 1 wherein the assembling step comprises:

curling the cut edge of the ring;

after curling the cut edge of the ring, inserting the disc into the ring; and after inserting the disc into the ring, curling the free edge of the ring.

* * * * *